US008844621B2

(12) United States Patent
Carro

(10) Patent No.: US 8,844,621 B2
(45) Date of Patent: Sep. 30, 2014

(54) HYDRAULIC WELL PACKER

(76) Inventor: Gustavo Ignacio Carro, Cipoletti Pcia de Rio Negro (AR)

( * ) Notice: Subject to any disclaimer, the term of this patent is extended or adjusted under 35 U.S.C. 154(b) by 235 days.

(21) Appl. No.: 13/593,770

(22) Filed: Aug. 24, 2012

(65) Prior Publication Data

US 2013/0213635 A1 Aug. 22, 2013

Related U.S. Application Data

(63) Continuation-in-part of application No. 12/500,709, filed on Jul. 10, 2009, now abandoned.

(30) Foreign Application Priority Data

Aug. 14, 2008 (AR) ..... P080103554

(51) Int. Cl.
*E21B 33/129* (2006.01)
*E21B 33/1295* (2006.01)

(52) U.S. Cl.
CPC ..... *E21B 33/1295* (2013.01); *E21B 33/1293* (2013.01)
USPC ..... 166/120; 166/139; 166/196

(58) Field of Classification Search
CPC E21B 33/129; E21B 33/1295; E21B 33/1293
USPC ..... 166/387, 206, 120, 123, 124, 138, 139, 166/181, 82, 196
See application file for complete search history.

(56) References Cited

U.S. PATENT DOCUMENTS

| | | | | | |
|---|---|---|---|---|---|
| 2,221,204 | A | * | 11/1940 | Santiage | 166/124 |
| 3,002,561 | A | * | 10/1961 | Baker et al. | 166/120 |
| 3,524,501 | A | * | 8/1970 | Armstrong | 166/182 |
| 3,714,983 | A | * | 2/1973 | Wilson | 166/120 |
| 3,744,563 | A | * | 7/1973 | McGill | 166/139 |
| 4,263,968 | A | * | 4/1981 | Garner, Jr. | 166/120 |

* cited by examiner

*Primary Examiner* — Kenneth L Thompson
(74) *Attorney, Agent, or Firm* — Gottlieb, Rackman & Reisman, P.C.

(57) ABSTRACT

A retrievable well packer for downhole operations, comprising an upper mandrel and a lower mandrel connected through a quick threaded connection, a hydraulic actuating assembly for downwardly moving under fluid pressure, a packing assembly for sealing against the well, first coupling mechanism between the upper mandrel and the hydraulic actuating assembly and second coupling mechanism between the lower mandrel and the hydraulic actuating assembly, with the second coupling mechanism connecting the lower mandrel and the hydraulic actuating assembly against rotation but permitting relative axial movement.

12 Claims, 6 Drawing Sheets

HYDRAULIC WELL PACKER

This application is the Continuation-In-Part application of U.S. patent application Ser. No. 12/500,709 filed on Jul. 10, 2009 which in turn claims priority from Argentinean Patent Application No. P 2008 0103554 filed Aug. 14, 2008.

BACKGROUND OF THE INVENTION

1. Field of the Invention

The present invention refers to a hydraulic packing device for wellbores, of the type employed in downhole operations, such as well intervention activities, and which may be combined with other well tools in wells such as production wells, injection well, oil wells, water wells, gas wells and the like, and more particularly it refers to a retrievable hydraulic packer comprising at least one sealing or packing assembly with packer elements and/or at least one anchoring assembly with anchor clamps or slips and/or at least one hold-down slips, which inventive packer may be run into the wellbore and expanded to anchor to and/or seal the wellbore at selective sections of the wellbore as well as it is capable of working with one or multiple sealing and/or anchor assemblies and/or holding assemblies, as well it is capable of being installed and retrieved as desired.

2. Description of the Prior Art

Several well packing devices or packer apparatus are well known in the art, which are currently downhole devices that are generally used to isolate the annulus between the casing or liner and the tubing or conduit for production, injection or treatment and they may include means of securing the packer against the casing wall, or anchor assembly, such as a slip arrangement, and a means of creating a reliable hydraulic seal to isolate the annulus, or sealing or packing assembly, by means of one or more expandable elastomeric elements. The expansion of the elastomeric elements and slips are generally obtained by axially operated compression mechanisms.

When the intervention activity in the well bore has finished and the packer must be released from the sealing and anchoring condition in the casing for retrieval, the compression mechanisms must be released and this operation may be carried out mechanically or hydraulically. In the mechanical releasing of more than one of packers, the stresses along the string impose the use of expansion joints in order not to add individual release efforts in the stress type releasing packers.

Other well packing devices include mechanisms that must be rotated to release the sealing and anchor assemblies. With installations of more than one packer it is almost impossible to rotate de all the string to obtain the individual rotation necessary for each assembly, wherein the sum of all the individual rotations will generate an excessive torque along the entire string.

Another known packer system is the double latch hydraulic packer which comprises a mandrel with a sealing assembly including a plurality of squeezable rubbers and a fastening or anchor assembly with clamps or slips capable of expanding in opposite axial directions to provide up and down anchorage. To release this packer the mandrel and the string connected thereto must be rotated.

To release and retrieve the above mentioned double latch packer several spins or turns must be done to unpack the rubbers and finally disengage the clamps. In wells with even some degrees of inclination or where, as part of the installation, there are also injection devices, it is very difficult, if not impossible, to generate the necessary turns to release the tool without generating high torque in the maneuvering string. It would be even more difficult if the installation includes more than one packer having this release assembly; in that case there would be an addition of the rotation efforts in each of the packers.

Even another type of well known packer is the hydraulic fastening and stress releasing packer. This kind of packer has the feature that, in order to release the tool once it has been fastened, traction must be applied over the mandrel to cut one or more shear pins of a safety assembly and to release the packer completely. If there are installations with several packers, all the packers behave as one string, therefore, the force necessary to cut all the pins is the sum of the forces necessary to cut each pin of the packers, which total force is extremely high. The production strings generally have a limited resistance to these traction forces. In other words, it is necessary to have some kind of intermediate supplementary device to compensate the forces of each packer and not to transmit the force downward to other packer. Another limitation to be taken into account is that, in some of these packers, the mechanical works of the tubing between packers derived from the pressure changes might generate stress or cuts in the safety mechanisms, which would cause an early release of the tools.

U.S. Pat. No. 3,054,450, to Baker, discloses a well packer comprising a packer apparatus A and a setting tool D with a mandrel 54 connected to a first intermediate mandrel portion 56 which is connected to a second intermediate mandrel portion 57. To release and retrieve the packer, Baker provides a tool E that must be inserted once setting tool D is removed. Tool E must be rotated to cause rotation of a sleeve 49 which rotation of sleeve 49 will cause, after several rotations and movements, the rotation of a sleeve 42 on the body threads 44 and feed upwardly along the body 10 (see column 7, lines 24-67). This imposes stresses on the system due to the necessary excessive torque by the rotation of the parts.

In view of the well pacer systems available it would be very convenient to have a new well packer that cab be easily anchored and sealed in a well casing, capable of being combined in a tubing with other pacers and tolls and capable of being released just through a quick disconnection of a quick connection requiring only a short turning of the tubing, preferably a quarter turn, in a manner that such disconnection between an upper mandrel and a lower mandrel can be reinstated into a new connection against rotation between the upper and lower mandrels, thus reinstating the capability of the tubing to follow disconnecting other packers that are installed downwardly in the casing.

SUMMARY OF THE INVENTION

It is therefore one object of the present invention to provide a retrievable well packer comprising at least one sealing or packing assembly and/or at least one anchoring assembly, which inventive packer operates with hydraulic fastening-anchoring and packing pressure as well as with a minimum unthreading mechanical movement, thus with a remarked simplicity in the release operation, which is highly recommendable in the use of selective installations of multiple packers, with the advantage of being able to fasten or release the packers selectively preventing the production or maneuver string from being subjected to traction efforts or excessive rotation.

It is another object of the present invention to provide a hydraulically/mechanically-operated retrievable well packer for packing against a well casing wherein the packer, as compared to packers of the prior art has several outstanding features that allow fulfilling the needs and overcoming the drawbacks of the existing packers, with the present packer including a split mandrel, namely a mandrel comprised of an upper part or upper mandrel, and a lower part or lower mandrel, both mandrels connected through a quick threaded connection, at least one packing assembly and, optionally, at least one anchoring assembly, a hydraulic actuating assembly to expand the packing assembly to seal the well and, optionally, the anchoring assembly, if provided, in a manner that, when the packer is released, the quick connection between the upper mandrel and the lower mandrel is disconnected and the upper mandrel is connected against rotation to the hydraulic actuating assembly and the lower mandrel, disconnected from the upper mandrel, is connected against rotation the hydraulic actuating assembly in order to have the upper and lower mandrels connected again against rotation to operate as only one mandrel, with the packer being prevented from being packed again.

It is another object of the present invention to provide a hydraulic retrievable well packer for packing against a well casing wherein the packer can be released and the tubing and the packer connected thereto may be operated as if it was a rigid assembly thus allowing to transmit stress, weight or torque, in an independent fashion downwardly the released packer, without consuming efforts to release another packer or other part of the installation, or to simply retrieve the packer and take it out of the well, with the packer operating under hydraulic pressure that activates a hydraulic chamber to start cutting shear pins and follow compressing packing rubbers of a packing assembly and, if provided, anchoring slips of an anchoring assembly, wherein the compression over the packing elements or rubbers and the anchoring slips is sustained by safety assembly that prevents its unpacking once the hydraulic pressure has been released.

It is even another object of the present invention to provide a retrievable well packer for downhole operations in a well casing of a wellbore, the packer comprising a mandrel including an upper mandrel connected to a lower mandrel both connected to each other through a quick threaded connection; a hydraulic actuating assembly for downwardly moving over along the upper mandrel and the lower mandrel upon receiving fluid pressure in a hydraulic pressure chamber defined between the hydraulic actuating assembly and the lower mandrel; at least one packing assembly for sealing against the casing upon downward movement of the hydraulic actuating assembly; first coupling means between the upper mandrel and the hydraulic actuating assembly and second coupling means between the lower mandrel and the hydraulic actuating assembly with the second coupling means connecting the lower mandrel and the hydraulic actuating assembly upon pressurization of the hydraulic pressure chamber, wherein, upon rotation of the upper mandrel relative to the lower mandrel, the quick thread connection between the upper mandrel and the lower mandrel is disconnected and the upper mandrel can be moved upwardly to connect to the hydraulic actuating assembly through the first coupling means, whereby the upper mandrel and the lower mandrel are connected to each other through the hydraulic actuating assembly, to transmit torque from the upper mandrel to the lower mandrel.

BRIEF DESCRIPTION OF THE DRAWINGS

For more clarity and comprehension of the object of the present invention, a figure has been drawn, as an example, in which the invention has been represented with the preferred embodiments, where.

DETAILED DESCRIPTION OF THE INVENTION

Figure 1A:
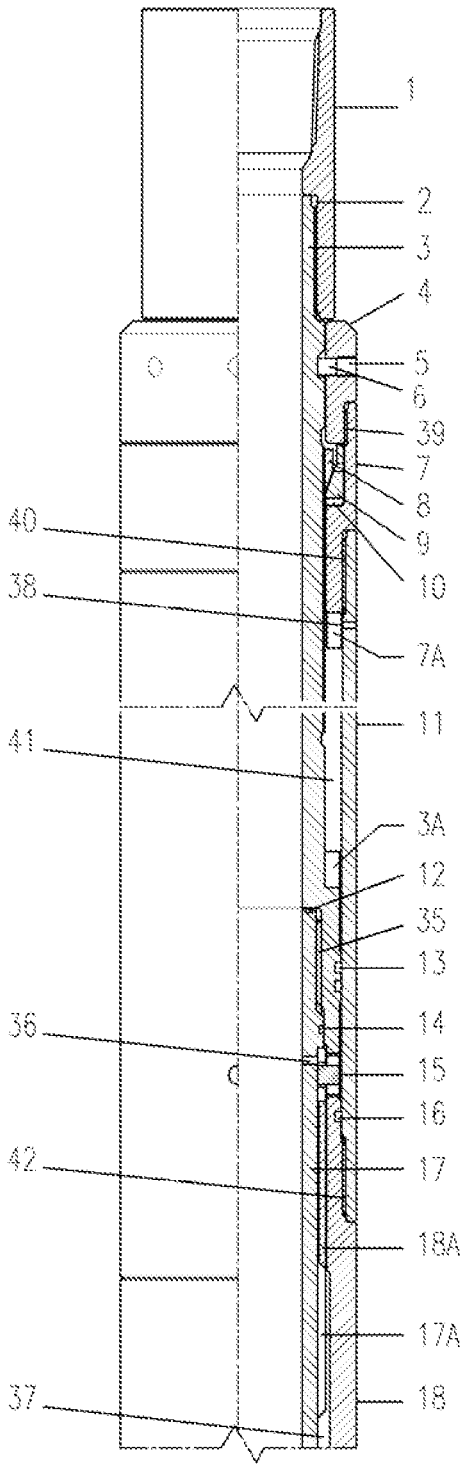
FIGS. 1*a* and 1*b* show partial longitudinal cross-section views of the packer according to one embodiment of the invention.
Figure 1B:
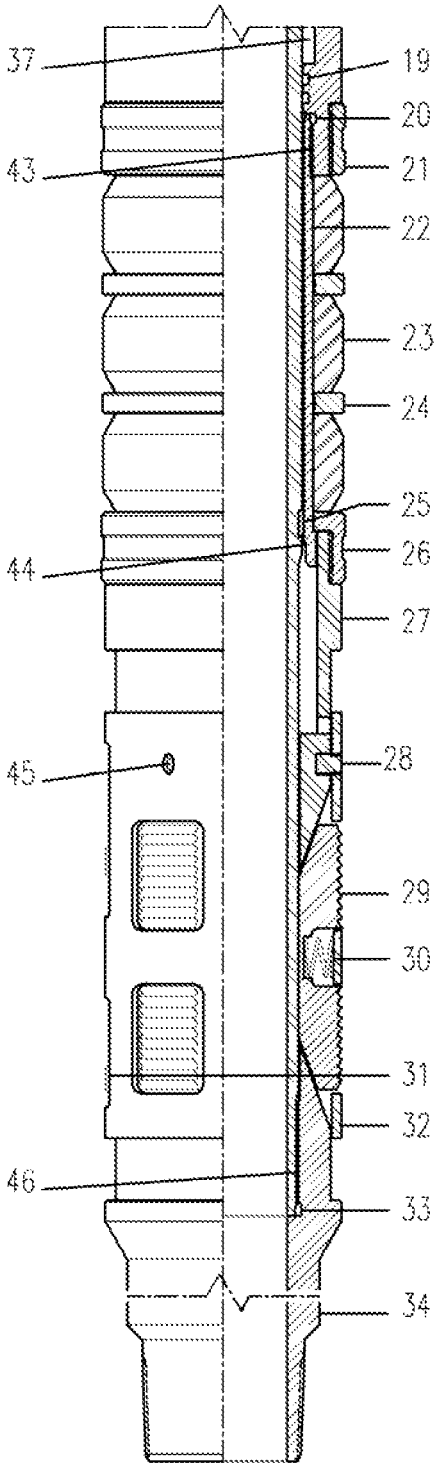
Figure 3:
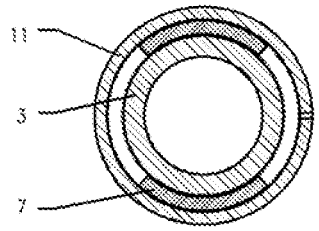
FIG. 3 shows a cross section of the packer taken at cut line A-A in FIG. 2*a*.
Figure 4:
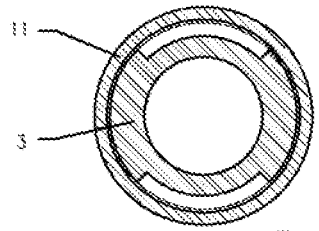
FIG. 4 shows a cross section of the packer taken at cut line B-B in FIG. 2*a*.
Figure 5:
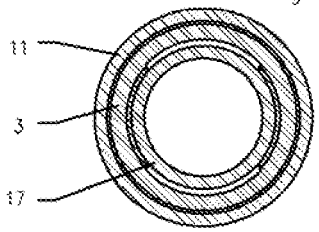
FIG. 5 shows a cross section of the packer taken at cut line C-C in FIG. 2*a*.
Figure 6:
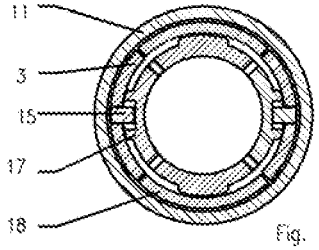
FIG. 6 shows a cross section of the packer taken at cut line D-D in FIG. 2*a*.
Figure 7:
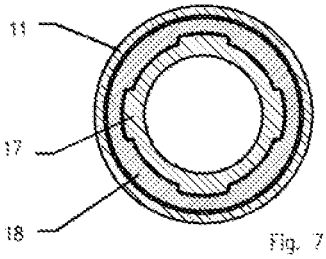
FIG. 7 shows a cross section of the packer taken at cut line E-E in FIG. 2*a*.

According to the exemplary device shown in FIGS. 1*a* and 1*b*, the present invention a retrievable hydraulic packer with packing and, optionally, anchoring assemblies, to be applied when it is necessary to isolate or seal temporarily or permanently a well area, with the possibility to carry out different operations, specially used on selective installations, such as oil, water or gas wells, or wells of different fluids.

The packer of the present invention comprises, in the upper end, an upper header 1, having a male or female thread, both to connect to a known tubing (not shown) and to a mandrel, as shown. According to the invention, the mandrel is split, namely it is comprised of an upper mandrel 3 and a lower mandrel 17 both connected to each other by a quick thread 35, also known as a quick thread connection, having an extension lower than a 360° turn, preferably lower than a 180° turn and more preferably a 90° turn extension. In other words, mandrels 3 and 17 can be disconnected by rotating the tubing just a quarter turn, to the right or left side. A seal 2 is arranged between mandrel 3 and header 1 to guarantee sealing between the interior of well packer and tubing and the exterior of the tool, namely the annular gap between the tubing and the casing (not shown).

A pin case 4 is retained on upper mandrel 3 by a plurality of safety shear pins 6 which are retained in place by screws 5, of which only one is shown. Screw 5 retains and presses the shear pins 6 against a notch formed in the periphery of upper mandrel 3, as it is well known in the art. A segment carrying sleeve 7 is threaded at 39 to pin case 4, which segment carrying sleeve 7 houses a segment 8, a segment carrying cone 9 and a friction ring 10 to provide a ratchet-type connection. Segment 8, as it is well known in the art, is provided with teeth having locking flanks extending in one direction while the periphery of mandrel 3 is provided with teeth having locking flanks extending in the opposite direction, in a manner that segment 8 is able to move down relative to mandrel 3 but unable to move up relative to mandrel 3. Cone 9 cooperates with segment 8 to provide this selective movement. For the purpose of description, case 4, screws 5, pins 6, sleeve 7, segment 8, cone 9 and friction ring 10 defines an unidirectional retaining assembly.

Segment carrying sleeve 7 has a lower end or edge provided with a plurality of teeth 7A, of the type known in the art as battlement-shaped teeth, for connecting similar opposing teeth 3A of mandrel 3, forming together first coupling means 3A, 7A, reference to which will be made below. A plurality of teeth, preferably battlement-shaped teeth 3A, are provided in a lower portion of upper mandrel 3, which teeth 3A are configured to intermesh and interconnect teeth 7A under a predetermined condition of operation as it will be explained below. Upper mandrel 3 and lower mandrel 17 are engaged by threaded quick connection 35 and the connection is sealed by seals 12, 14, preferably o-ring seals. The connection between mandrels 3, 17 is completed by shear pins 15 which prevent connection 35 from being disengaged by an incidental torque that would provoke the undesired release of the tool. For that purpose, shear pins 15 are calibrated with a calculated torque resistance to break upon exceeding the predetermined torque to permit disengaging connection 35 and subsequent releasing of the tool as it will be explained.

A hydraulic sleeve 11 is threadably connected, at 40, to segment carrying sleeve 7, which hydraulic sleeve 11 is provided with a pressure balance orifice 38 which connect a space or gap 41 between upper mandrel 3 and sleeve 11 with the exterior of the tool, namely the annular gap between the tool and the well casing (not shown). Sleeve 11 can slidably move over mandrel 3 and sealed against mandrel 3 by seals 13, preferably o-rings.

Hydraulic sleeve 11 is connected to a joint sleeve 18 by a thread 42, with a seal 16 retained between sleeves 11, 18 to seal the connection. Second coupling means, preferably conformed by a spline joint, formed by ridges or teeth and grooves, 17A in lower mandrel 17 and 18A in sleeve 18, is provided in a manner that allows relative longitudinal movement between mandrel 17 and sleeve 18 but prevent rotational movement between them. In other words, when spline joint is engaged the rotation of sleeve 18 will cause the rotation of mandrel 17 and torque will be transmitted, when necessary. A seal 19, preferably an o-ring, is provided between sleeve 18 and mandrel 17, therefore a hydraulic pressure chamber 37 is defined by seal 14, provided between mandrels 3, 17, by seal 13, provided between sleeve 11 and mandrel 3, by seal 16, provided between sleeves 11, 18, and by seal 19, provided between sleeve 18 and mandrel 17. A pressure injection orifice 36 is provided in an upper portion of mandrel 17 to communicate the interior of the mandrels with chamber 37 and allows injection operating fluid pressure from the tubing, pumped from the well surface, through orifice 36, into chamber 37. As it will be explained below, the pressure into chamber 37 will move sleeves 11, 18 downwardly relative mandrels 3, 17 the sealing or packing assembly and, if provided, the anchoring assembly, which will be disclosed below.

An upper gauge ring 21 is threaded to joint sleeve 18, which upper gauge ring 21 can be one of several rings, the rings being configured with different diameters according to the internal diameters of the well casing. The above disclosed components identified by reference numbers 4-7, 7A, 8-11, 18 define a hydraulic actuating assembly for downwardly moving over along upper mandrel 3 and lower mandrel 17 upon receiving fluid pressure in hydraulic pressure chamber 37.

Joint sleeve 18 is threaded, at 43, to a packing or sealing assembly comprising a packer elements-carrying sleeve 22, including a plurality of sealing or packing components 23, preferably elastomeric or rubber-made elements, separated by spacer rings 24 and a lower gauge ring 26. Sleeve 22 is mounted over mandrel 17 in a manner that sleeve 22 can move along mandrel 17, and elements 23 are retained between rings 21, 26 and are capable of being longitudinally compressed to expand radially and seal against the well casing. Ring 26 is retained by a step or enlarged edge 44 of sleeve 22.

The packing assembly, indicated by reference numbers 21-26, as described above, can be configured with varying dimensions and geometry according to the operational needs, as well as with different number of elements 23 and rings 24, in order to have a higher tightness if needed. In the case of the illustrated embodiment, the packer is configured with an assembly of three rubber made elements 23 and two spacer rings 24. The configurations of rubbers 23 in terms of hardness, diameters and geometry may change depending on the internal diameters of the well casing.

A locking ring 25 is retained into a groove in mandrel 17 and restrained by compression between mandrel 17 and sleeve 22, and the function thereof is to retain sleeve 22 in a position vertically above ring 25 when the pressure is released in chamber 37 and the elastic elements 23 are uncompressed and hydraulic actuating assembly is restored to the initial position and moved upwardly above ring 25. In other words, the ring is compressed under sleeve 22 but as soon as sleeve 22 is moved vertically up of ring 25 this ring is released and expanded forming a stop for the lower edge of sleeve 22 preventing sleeve 22 from moving downwards again. In this way, the packing and anchoring assemblies are secured in an upper position and cannot return to the compression state. This allows to handle the tool in the well freely and without running the risk of being stuck or anchored when not longer desired.

According to the embodiment of FIGS. 1*a* and 1*b*, the tool of the invention also includes an anchoring assembly comprising one or more set of clamps or slips, such as unidirectional or bidirectional latch, depending on the configurations of the wells and the forces involved, with the clamps having, for example, hardened treated latch tines or hard metal inserts. The anchoring assembly of the illustrated embodiment comprises a package of clamps or slips 29 which are contained into a cage, such as a slips carrying sleeve 32, and resiliently urged towards the interior of sleeve 32 to the position depicted in FIG. 1*b*. Slips 29 are also contained by an upper cone member 27 and a lower cone member 34 slidably mounted on mandrel 17. Cone member 27 is retained in an initial passive position regarding sleeve 32 by means of shear pins 28 housed on a lower portion of upper cone member 27 and a corresponding orifice 45 in sleeve 32. The purpose of pin 28 is to prevent any involuntary movement of the parts of the anchoring assembly and therefore prevent any expansion and anchoring against the well casing before the desired moment for anchoring. Lower cone member 34 is connected, by threaded connection 46 to a bottom end of lower mandrel 17 and a seal 33, such as an o-ring, is provided between cone member 34 and mandrel 17. A bottom end of lower cone member 34 is threaded, with a male or female thread, according to the installation connection that is below the packer.

Operation of the retrievable well packer:

While the operation of the well packer will be disclosed in connection to the embodiment of FIGS. 1*a* and 1*b*, this operation is also applicable to other embodiments, such as the ones of FIGS. 2*a*, 2*b*, 3-13 wherein the packer may comprise one or more packing assemblies as well as one or more anchoring assemblies, to be installed in different sections of the well casing. For operation purposes of the packing and release, the same operative individual maneuvers may be considered for several assemblies.

As disclosed above, the inventive tool comprises a mandrel formed by upper 3 and lower 17 mandrel portions, hydraulic actuating assembly 4-7, 7A, 8-11, 18, 35, 36, 37 including unidirectional retaining assembly 4, 5, 6, 7, 7A, 8, 9, 10, packing assembly 21, 22, 23, 24, 25, 26 and, if provided as it is in this embodiment, anchoring assembly 27, 28, 29, 32, 34.

Installation (Fastening)

As above disclosed, header 1 is threadably connected to a conduit or tube well known in the art, namely a tubing (not shown), employed to circulate working fluids, for operation of tools like the well packer of the invention, for example. The well packer, connected to the tubing, is run downwardly into the well casing up to a section wherein it must be affixed or installed, preferably temporarily. As it is well known in the art, the tubing has a seat defining a restriction in some section thereof, downwards the well packer or an orifice of the well packer through which the fluid must enter to actuate the corresponding packer. Fluid is injected into and all along the tubing and, when the packer reaches the desired position into the well casing a ball is inserted in the tubing which ball will be pushed and carried along the tubing until reaching the above mentioned seat wherein the ball seats and closes the interior of the tubing to the circulation of fluid. Under those circumstances the pressure increases into the tubing and pressurized fluid passes through orifice 36 into chamber 37, which pressurized fluid exerts a strong force against hydraulic actuating assembly 4-7, 7A, 8-11, 18, 35, 36, 37 and breaks pins 6. With pins 6 broken, the hydraulic actuating assembly moves down along mandrel 3, 17, which remains connected by connection 35. It must be remembered that unidirectional retaining assembly comprising pin case 4, segment 8, segment carrying sleeve 7, segment carrying cone 9 and friction ring 10, permits this downward movement but prevent this assembly form moving upwardly relative the mandrel. This is because of segment 8 having a saw tooth thread or ratchet on its internal diameter which system can move downwardly along upper mandrel 3, which also has a saw tooth thread or ratchet on its external diameter, but can not move upwardly.

With the hydraulic actuating assembly moving downwardly, and prevented from moving upwardly, packer elements 23 are compressed vertically by the bottom end of sleeve 18 and ring 21 under the force exerted by the fluid into chamber 37, which pressure cut pins 6, as well as under the weigh of the tubing upwards the well packer. Indeed, pressure into chamber 37 is necessary just to cut pins 6 while the weight of the string of tubing is enough to apply the necessary force to actuate the hydraulic actuating assembly to compress and expand the packing assembly 22-24. The radial expansion of elements 23 will seal the well casing.

By moving downwardly, the hydraulic actuating assembly also actuates onto the anchoring assembly if provided. Thus, the hydraulic actuating assembly moves cone member 27 downwardly, cutting pins 28 and compressing cone members 27, 34 causing them to relatively move towards each other and slip under slips 29 causing them move radially outwardly against the resiliency of spring 30. Slips or clamps 29 are provided, as it is well known in the art, with any kind of teeth, nails o texture enough to grip against the well casing and anchor the well packer firmly in the casing. In that condition, the packing assembly and the anchoring assembly will be hanging from the mandrels 3, 17 and the tubing, that is, without the weight of the string actuating onto the hydraulic actuating assembly.

Once anchoring assembly, if provided, is anchored against well casing and packing or sealing assembly is sealed or packed against the well casing, the pressure of the fluid inside the tubing and chamber 37 will follow increasing providing an extreme gripping of the anchoring assembly and sealing of the packing assembly until the seat, wherein the ball closing the interior of the tubing is seated, breaks under the extreme fluid pressure and the circulation through the interior of the tubing is restored. If more than one packing and anchoring assembly the seat will be arranged at the end of the tubing or string. With the seat for the ball broken the pressure dramatically falls down within the tubing. At that moment, the packing assembly that is pressed with the hydraulic packing force will try to restore itself to the initial uncompressed condition due to the shape memory nature of packing elements 23, however this will be prevented by unidirectional retaining assembly 4, 7, 8, 9, 10 which can not move upwardly and retain the hydraulic actuating assembly in its lower position compressing the packing assembly and the anchoring assembly and keeping them sealed and anchored against the well casing. At this instance, the annular space between the tubing and the casing is sealed but the interior of the tubing is open to but allow circulation of fluids and application of hydraulic pressures where necessary. As mentioned above, the string may include just one packer or multiple packers.

Disengaging (Releasing)

Once the intervention activities into the wellbore have finished the well packer of the invention can be released or disengaged and retrieved to leave the section of the well casing entirely open. In order to release the packer, the string or tubing must be turned right or left, according to the configuration of the string, exceeding the configured torque resistance of calibrated shear pins 15, to cut the pins. Once cut, pins 15 allow upper mandrel 3 to rotate, preferably just a quarter turn, and disengage from lower mandrel 17. The tubing and mandrel 3, which are connected by thread at header 1, are raised and disengaged completely from the quick connection 35. Upon raising of mandrel 3 the hydraulic actuating assembly will move up with the mandrel and the packing assembly and the anchoring assembly will be decompressed. Thus, sleeve 18 will move upwardly and elements 23 will come back to their relaxed non-expanded shape and cone member 27 will move also upwardly in order to cause slips 29 move radially inwardly under the effect of spring 30. Any residual pressure inside gap 41 will escape through orifices 38 and the pressure within chamber 37 will compensate with the pressure inside the tubing through orifice 36.

Upper mandrel 3 continues being lifted, permitted by segment 8 that continues moving down relative and over mandrel 3, up to the engagement between teeth 3A and 7A, at which engagement mandrel 3 is connected against rotation to hydraulic actuating assembly 4-7, 7A, 8-11, 18, 35, 36, 37 and, through spline joint 17A, 18A, to lower mandrel 17. In this condition torque can be transmitted from mandrel 3 to mandrel 17. If lifting of mandrel 3 is continued, as desired, sleeve 22 will move up of ring 25 uncovering the ring and leaving the ring free to expand outwardly. Once expanded, ring 25 will form a stop for the packing assembly preventing sleeve 22 to move towards a position down the ring again. Thus, upper mandrel can transmit weight and or torque to mandrel 17 and the arrangement can actuate as a single or rigid unit to follow operating other well packers if provided downstream. The packer of the present invention is thus capable of operating for releasing another packer that is located below the first one and, in turn, this another packer can permit to release other ones downstream, without having torque added to each other, which allows performing one selective release operation at a time for each packer located on the installation.

The operation for releasing the packer is carried out without the need of removing the tubing and inserting another tool, as it is necessary in U.S. Pat. No. 3,054,450 mentioned above. In effect, the two parts mandrel 3, 17 of the present invention, once disconnected from connection 35 remains connected, to prevent relative rotation, through the first coupling means and second coupling means. Distinct from that, the mentioned prior art needs to disconnect setting tool D from packer A and connect retrieving tool E to packer A to retrieve packer A. The present invention does not need an additional tool E but only to disconnect the quick connection 35 between upper mandrel 3 and lower mandrel 17, by rotating string C along a short turn, breaking shear pin 15, and connecting teeth 3A with teeth 7A to connect against rotation mandrel 3 to assembly 4-10. Thus, upper mandrel 3 will be capable of transmitting torque to lower mandrel 17 through assembly 4-10, teeth 3A, 7A, assembly 11-18 and spline joint 17A, 18A. Therefore, with just a short turning of upper mandrel 3 relative lower mandrel 17 the packer can be released without the need of any additional tool.

The release of the inventive packer is achieved with less than one turn of the maneuver or production string, without transmitting torque at the lower part of the packer when releasing the packer, due to the fact that the split mandrel is connected with a quick thread connection. Once this thread is disengaged, the upper mandrel is raised and the packing assembly contained is released; the string keeps being raised while the clamps are released. Then the upper mandrel is connected to the hydraulic actuating assembly which in turn is connected to the lower mandrel of the packer. In this way, the packer is absolutely free in terms of the tightness of the packing elements, in the shape of rubbers, over the well casing, and in terms of the casing latch or anchoring, allowing it to release another packer under itself or under part of the installation, as in this state it will transmit, stress, torque or weight as a solid whole.

Another great advantage is that, due to the geometry of the mechanism, the packer of the present invention provides larger interior diameters in the junctions of the mandrel, which are very useful in the use of this type of packer for the selective installations, as it is very common to pass tools of smaller diameter through the mandrel of the packer.

The inventive packer also has the advantage that, at the moment of the release, a rotation of the upper mandrel can be carried out of less than one independent spin or turn of the lower part, without transmitting torque at that moment towards the lower part of the tool and, as a result, towards the rest of the installation. This is because the present packer has a split mandrel that, at the moment of releasing, allows to apply only the torque necessary to release the quick thread connection, and to start with the release of the packer, without transmitting that torque downward. After the thread quick connection is released, the tubing is raised and the packing elements loose compression. As a result of that upward movement, the slips or clamps are released and, at the same time, the upper mandrel is connected to the hydraulic actuating assembly through teeth 3A, 7A, allowing the connection to the lower mandrel; therefore, with just a small torque of less than one turn and an upward movement, not only the packer in question is released, but it is also ready to act as a rigid assembly to exert rotation movements of weight and traction in order to keep moving the string, with the aim of releasing other adjacent lower packer and other tools of the installation.

Figure 2A:
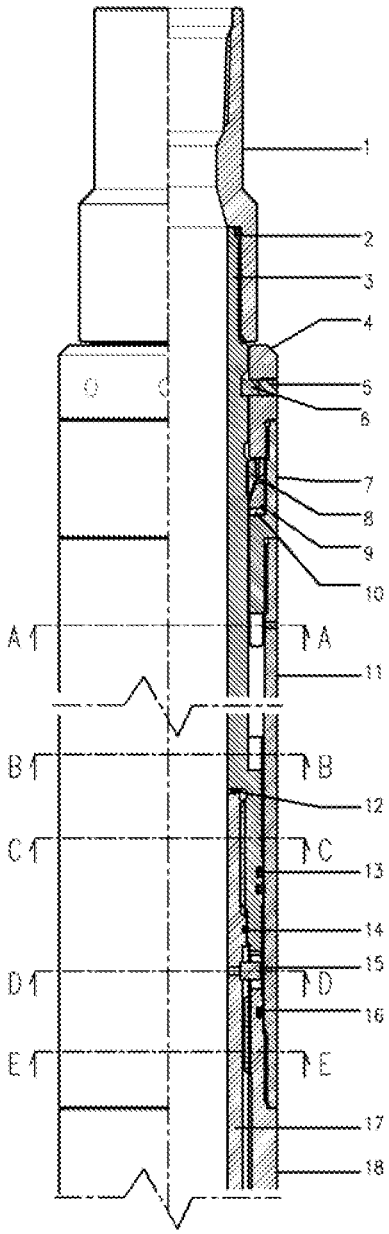
FIGS. 2*a* and 2*b* show partial longitudinal cross-section views of the packer according to another embodiment of the invention.
Figure 2B:
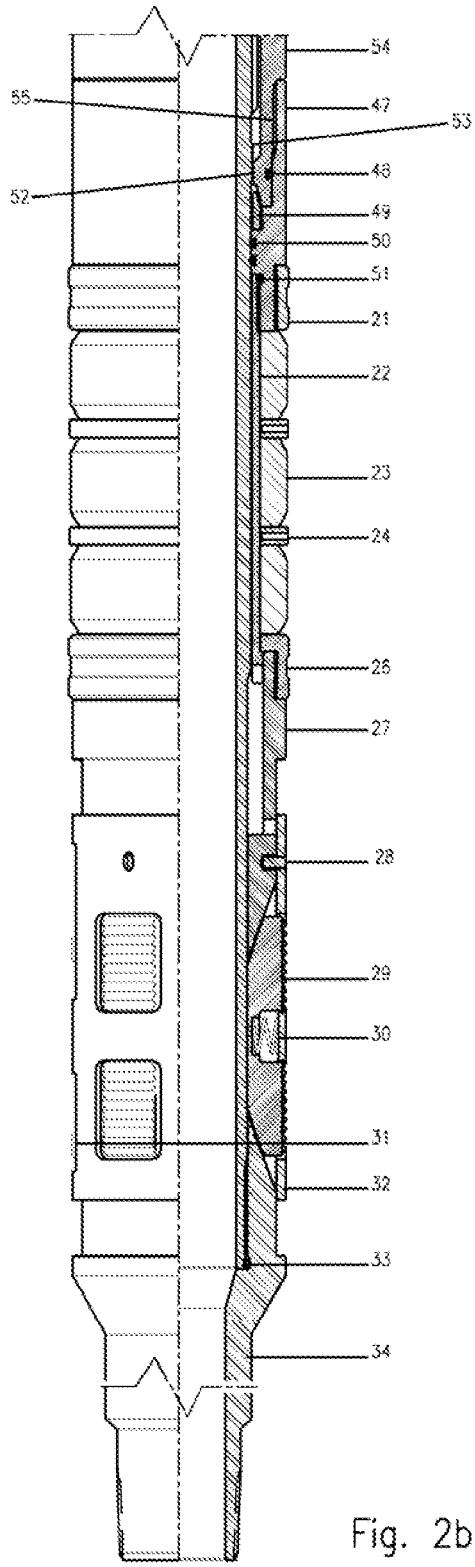

According to another embodiment of the invention, illustrated in FIGS. 2*a*, 2*b* and 3-7, locking ring 25 of FIGS. 1*a*, 1*b*, has been eliminated and a new locking system has been provided and which comprises a locking sleeve 47 threaded, at 55, to a bottom end 54 of sleeve 18. The same reference number has been employed to identified sleeve 18 of FIGS. 1*a*, 1*b*, however the sleeve, while having the same configuration at the upper part thereof, has been modified at the bottom portion as it is shown in FIG. 2*b*. Thus, bottom end 54 includes an enlarged section 52 that, in a stationary position shown in FIG. 2*b*, will locate preferably in front of a section 53 of lower mandrel 17. Section 53 comprises saw tooth threads or ratchet on its external surface. The connection between sleeve 18 and locking sleeve 47 is sealed by a seal 48, and seals 50, 51 are also provided to seal between locking sleeve 47 and mandrel 17 and between locking sleeve 47 and sleeve 22, respectively.

A locking segment 49 is retained between lower mandrel 17, bottom end 54 of sleeve 18 and locking sleeve 47 with the purpose, as it will be explained below, of preventing sleeves 18, 47 from moving down once the packing assembly has been unpacked and upper mandrel 3 has been lifted, for example, as it was explained above in relation to the embodiment of FIGS. 1*a*, 1*b*. More particularly, segment 8, preferably a split ring, has a saw tooth thread design or ratchet on its internal diameter, whereby when the packing assembly has been unpacked and upper mandrel moved upwardly, segment 49 moves upwardly as well together with locking sleeve 47 and, when located onto ratchet section 53, segment 49 will be prevented from moving down again because the saw tooth or ratchet on its internal diameter will actuate against the saw tooth or ratchet of section 53. This situation is clearly shown in FIG. 9.

Figure 8:
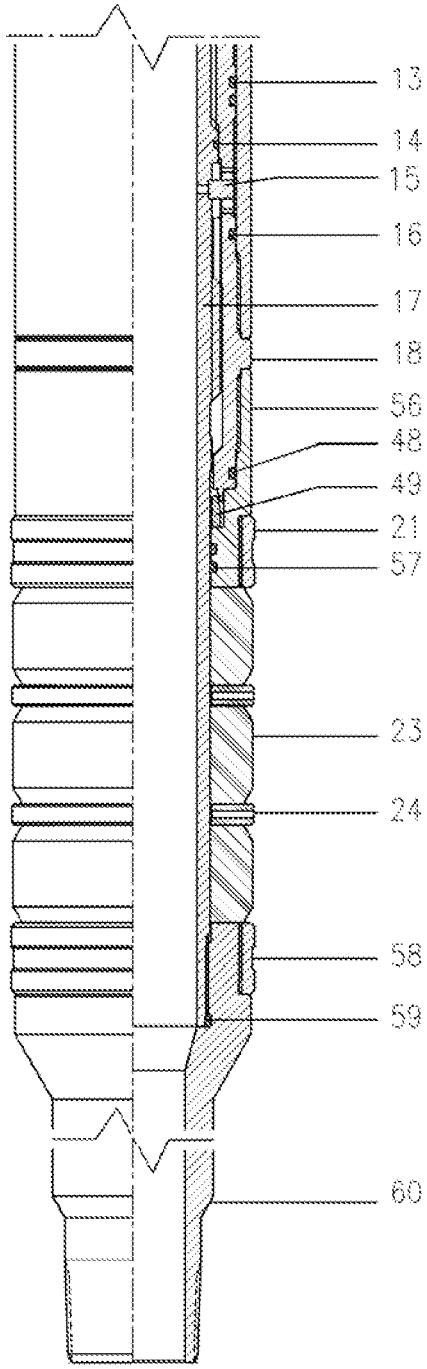
FIG. 8 shows a partial longitudinal cross-section view of the packer according to another embodiment of the invention.
Figure 9:
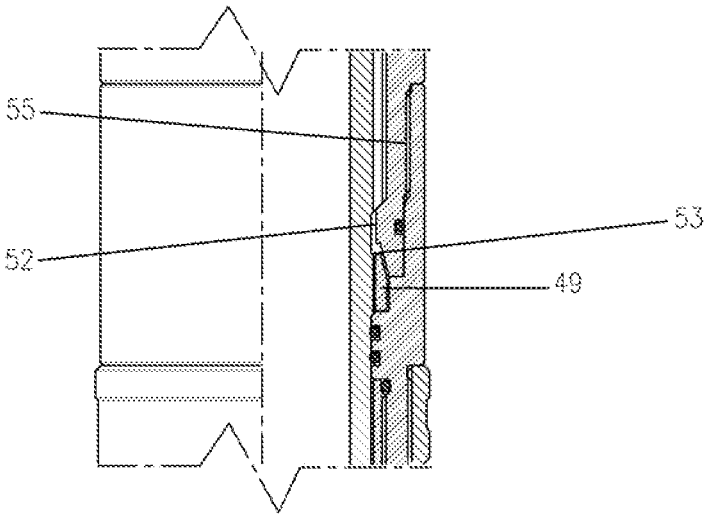
FIG. 9 shows a detailed partial longitudinal cross-section view of the packer of FIG. 2*b*, in a position with the packing assembly unpacked.

In accordance with even another embodiment of the invention, FIG. 8 shows a variation of the tool of FIGS. 1-7 in which new embodiment the anchoring assembly has been eliminated and only one or more packing assemblies are provided. In this embodiment only one packing assembly is shown and locking sleeve 47 of FIG. 2*b* has been replaced by locking sleeve 56 having a bottom end sealing against lower mandrel 17 by one or more seals 57. No packer elements-carrying sleeve 22 is provided in this embodiment and, instead, the packing elements 23 and spacers 24 are directly mounted on lower mandrel 17. At the bottom of the packer, a connector end 60 is provided to connect to other packers or tools and the connector end includes a bottom ring 58 and a seal 59 to seal the threaded connection between the connector end 60 and the lower mandrel. Packer elements 23 will be compressed and expanded upon the downward movement of the hydraulic actuating assembly including, in this embodiment, locking sleeve 56, more particularly, elements 23 will be squeezed between sleeve 56 and connector end 60.

I claim:

1. A retrievable well packer for downhole operations in a well casing of a wellbore, the packer comprising:

a mandrel including an upper mandrel 3 connected to a lower mandrel 17 both connected to each other through a quick threaded connection, a hydraulic actuating assembly 4-7, 7A, 8-11, 18 for downwardly moving over along the upper mandrel 3 and the lower mandrel 17 upon receiving fluid pressure in a hydraulic pressure chamber 37 defined between the hydraulic actuating assembly and the lower mandrel 17, at least one packing assembly for sealing against the casing upon downward movement of the hydraulic actuating assembly, first coupling means 3A, 7A between the upper mandrel 3 and the hydraulic actuating assembly 4-7, 7A, 8-11, 18, and second coupling means 17A, 18A between the lower mandrel 17 and the hydraulic actuating assembly 4-7, 7A, 8-11, 18, with the second coupling means connecting the lower mandrel and the hydraulic actuating assembly against rotation but permitting relative axial movement, wherein, upon rotation of the upper mandrel relative to the lower mandrel, the quick thread connection between the upper mandrel and the lower mandrel is disconnected and the upper mandrel can be moved upwardly to connect to the hydraulic actuating assembly through the first coupling means, whereby the upper mandrel 3 and the lower mandrel 17 are connected to each other through the hydraulic actuating assembly, to transmit torque from the upper mandrel to the lower mandrel.

2. The retrievable well packer of claim 1, wherein the quick threaded connection comprises a quarter turn thread connection, capable of permitting upper mandrel to disengage from the lower mandrel upon a quarter turn of the upper mandrel relative the lower mandrel.

3. The retrievable well packer of claim 1, wherein the hydraulic actuating assembly comprises a unidirectional retaining assembly comprising a pin case with shear pins connecting the case to the upper mandrel, and a segment carrying sleeve containing a segment housed into a cone member and a friction ring, with the segment being movable mounted along the upper mandrel with unidirectional movement capacity.

4. The retrievable well packer of claim 3, wherein the segment is coupled to the upper mandrel through a ratchet connection to be able to move only downwardly relative to the upper mandrel.

5. The retrievable well packer of claim 3, wherein the hydraulic actuating assembly further comprises a hydraulic sleeve connected, at one end, to the segment carrying sleeve, and at the opposite end, to a joint sleeve, with the hydraulic actuating assembly being capable of moving along upper and lower mandrels and being sealed against the mandrels to form a hydraulic pressure chamber for receiving pressurized fluid through a pressure injection orifice provided in the lower mandrel and communicating the hydraulic pressure chamber with an interior of the well packer.

6. The retrievable well packer of claim 5, wherein a pressure balance orifice is provided in the hydraulic sleeve communicating a space between the upper mandrel and the hydraulic sleeve to outside the well packer.

7. The retrievable well packer of claim 5, wherein the first coupling means comprises intermeshing teeth provided both, in a lower end of the segment carrying sleeve and in a lower portion of the upper mandrel, with the teeth being of the battlement-shape type and capable of connecting to each other upon movement of the segment carrying sleeve relative to upper mandrel.

8. The retrievable well packer of claim 5, wherein the second coupling means comprises a spline joint provided between the lower mandrel and the joint sleeve.

9. The retrievable well packer of claim 5, wherein the at least one packing assembly comprises a packer elements-carrying sleeve including a plurality of packing components capable of being longitudinally compressed by the hydraulic actuating assembly to expand radially and seal against the well casing.

10. The retrievable well packer of claim 9, wherein the packing components comprise elastomeric elements.

11. The retrievable well packer of claim 9, wherein a locking ring is retained in the lower mandrel and restrained by compression between the lower mandrel and the packer elements-carrying sleeve, in a manner that, when the packer elements-carrying sleeve is moved up to uncover the locking ring, the locking ring is free to expand and define a stop for preventing any movement of the packer elements-carrying sleeve down the locking ring.

12. The retrievable well packer of claim 9, further comprising at least one anchoring assembly for anchoring the packer against the well casing, the at least one anchoring assembly comprising a slips carrying sleeve containing a plurality of slips resiliently urged to remain into the slips carrying sleeve, and a couple of opposing cone members for moving relative one towards the other below the slips to expand the slips out of the slips carrying sleeve to anchor against the well casing.

* * * * *